US007233299B2

(12) United States Patent
Thevenot et al.

(10) Patent No.: US 7,233,299 B2
(45) Date of Patent: Jun. 19, 2007

(54) MULTIPLE-BEAM ANTENNA WITH PHOTONIC BANDGAP MATERIAL

(75) Inventors: Marc Thevenot, Peyrilhac (FR); Régis Chantalat, Limoges (FR); Bernard Jecko, Rilhac-Rancon (FR); Ludovic Leger, Limoges (FR); Thierry Monediere, Limoges (FR); Patrick Dumon, Vigoulet-Auzil (FR); Hervé Legay, Plaisance du Touch (FR)

(73) Assignees: Centre National de la Recherche Scientifique (C.N.R.S.), Paris (FR); Centre National d'Etudes Spatiales, Paris (FR)

( * ) Notice: Subject to any disclaimer, the term of this patent is extended or adjusted under 35 U.S.C. 154(b) by 0 days.

(21) Appl. No.: 10/532,655

(22) PCT Filed: Oct. 23, 2003

(86) PCT No.: PCT/FR03/03145

§ 371 (c)(1),
(2), (4) Date: Dec. 20, 2005

(87) PCT Pub. No.: WO2004/040694

PCT Pub. Date: May 13, 2004

(65) Prior Publication Data

US 2006/0125713 A1 Jun. 15, 2006

(30) Foreign Application Priority Data

Oct. 24, 2002 (FR) ..... 02 13326
Jul. 31, 2003 (FR) ..... 03 09472

(51) Int. Cl.
*H01Q 15/14* (2006.01)

(52) U.S. Cl. ..... 343/912; 343/840; 343/700 MS

(58) Field of Classification Search ..... 343/912, 343/700 MS, 840, 756, 909, 753, 781 CA; 333/134, 202; 359/248
See application file for complete search history.

(56) References Cited

U.S. PATENT DOCUMENTS 4,236,161 A 11/1980 Ohm ..... 343/781 CA
5,825,333 A * 10/1998 Kudoh et al. ..... 343/781 R (Continued)

FOREIGN PATENT DOCUMENTS

FR 2 801 428 A1 5/2001

OTHER PUBLICATIONS

Chung K.B. et al. "Defect modes in a two-dimensional square-lattice photonic crystal" Optics Communications, North-Holland Publishing Co. Amsterdam, NL, vol. 209, No. 4-6 , Aug. 15, 2002, pp. 229-235, XP004375303 ISSN: 0030-4018.

(Continued)

*Primary Examiner*—Trinh Dinh
*Assistant Examiner*—Huedung Mancuso
(74) *Attorney, Agent, or Firm*—Young & Thompson

(57) ABSTRACT

A system includes a device for focusing electromagnetic waves, and a multiple-beam antenna. The antenna includes: a photonic bandgap material (20) having at least one band gap, at least one periodicity defect (36) of the photonic bandgap material so as to produce at least one narrow bandwidth within the bandgap material, and excitation elements (40 to 43) for transmitting and/or receiving electromagnetic waves within the at least one narrow bandwidth, the elements being arranged relative to one another so as to produce overlapping radiating spots.

11 Claims, 7 Drawing Sheets

U.S. PATENT DOCUMENTS

| | | | | |
|---|---|---|---|---|
| 6,262,830 | B1 | 7/2001 | Scalora | 359/248 |
| 6,424,319 | B2 * | 7/2002 | Ebling et al. | 343/911 L |
| 6,441,699 | B2 * | 8/2002 | Yamada et al. | 333/111 |
| 6,597,323 | B2 * | 7/2003 | Teshirogi et al. | 343/786 |
| 6,606,077 | B2 * | 8/2003 | Ebling et al. | 343/911 L |

OTHER PUBLICATIONS

Thevenot M. et al. "Directive Photonic-Bandgap Antennas", IEEE Transactions on Microwave Theory and Techniques, IEEE Inc. New York, US, vol. 47, No. 11, Nov. 1999, pp. 2115-2121, XP000865109 ISSN: 0018-9480, figures 10, 11.

Shi B. et al., "Defective Photonic Crystals with Greatly Enhanced Second-Harmonic Generation", Optics Letters, Optical Society of America, Washington, US, vol. 26, No. 15, Aug. 1, 2001, pp. 1194-1196, XP001110592, ISSN: 0146-9592.

* cited by examiner

MULTIPLE-BEAM ANTENNA WITH PHOTONIC BANDGAP MATERIAL

The invention relates to a multiple-beam antenna comprising:

a photonic bandgap material for filtering electromagnetic waves spacewise and frequencywise, this photonic bandgap material having at least one bandgap and forming an outer surface radiating in transmit and/or receive mode, at least one periodicity defect of the photonic bandgap material so as to produce at least one narrow bandwidth within said at least one bandgap of this photonic bandgap material, and an excitation device for transmitting and/or receiving electromagnetic waves within said at least one narrow bandwidth produced by said at least one defect.

Multiple-beam antennas are very widely used in space applications and in particular in geostationary satellites for transmitting to the Earth's surface and/or receiving information from the Earth's surface. For this, they include a number of radiating elements each generating a beam of electromagnetic waves spaced apart from the other beams. These radiating elements are, for example, placed near the focal point of a parabola forming an electromagnetic wave beam reflector, the parabola and the multiple-beam antenna being housed in a geostationary satellite. The parabola is for directing each beam onto a corresponding area of the Earth's surface. Each area of the Earth's surface lit by a beam from the multiple-beam antenna is commonly called a coverage area. Thus, each coverage area corresponds to a radiating element.

Currently, the radiating elements used are known as "horns" and the multiple-beam antenna equipped with such horns is known as horn antenna. Each horn produces a roughly circular radiating spot forming the base of a conical beam radiated in transmit and/or in receive mode. These horns are placed alongside each other so as to keep the radiating spots as close as possible to each other.

FIG. 1A diagrammatically represents a multiple-beam horn antenna seen from the front, in which seven squares F1 to F7 indicate the footprint of seven horns placed contiguous to each other. Seven circles S1 to S7, each inscribed in one of the squares F1 to F7, represent the radiating spots produced by the corresponding horns. The antenna of FIG. 1A is placed at the focal point of a parabola of a geostationary satellite for transmitting information to France.

FIG. 1B represents the −3 dB coverage areas C1 to C7, each corresponding to a radiating spot of the antenna of FIG. 1A. The center of each circle corresponds to a point on the Earth's surface where the received power is maximum. The circumference of each circle delimits an area inside which the received power on the Earth's surface is greater than half of the maximum received power at the center of the circle. Although the radiating spots S1 to S7 are practically contiguous, the latter produce −3 dB coverage areas that are separate from each other. The regions situated between the −3 dB coverage areas are, here, called reception gaps. Each reception gap therefore corresponds to a region of the Earth's surface where the received power is less than half of the maximum received power. In these reception gaps, the received power may be inadequate for a receiver on the ground to be able to operate correctly.

To overcome this reception gap problem, it has been proposed to make the radiating spots of the multiple-beam antenna overlap. A partial front view of such a multiple-beam antenna with a number of overlapping radiating spots is illustrated in FIG. 2A. In this figure, only two radiating spots SR1 and SR2 are represented. Each radiating spot is produced from seven radiation sources that are independent of and separate from each other. The radiating spot SR1 is formed from the radiation sources SdR1 to SdR7 placed contiguous to each other. A radiating spot SR2 is produced from the radiation sources SdR1, SdR2, SdR3 and SdR7 and radiation sources SdR8 to SdR10. The radiation sources SdR1 to SdR7 are suited to working at a first working frequency to produce a first beam of electromagnetic waves roughly uniform at this first frequency. The radiation sources SdR1 to SdR3 and SdR7 to SdR10 are suited to working at a second working frequency to produce a second beam of electromagnetic waves roughly uniform at this second working frequency. Thus, the radiation sources SdR1 to SdR3 and SdR7 are designed to work simultaneously at the first and second working frequencies. The first and second working frequencies are different from each other so as to limit interference between the first and second beams produced.

Thus, in such a multiple-beam antenna, radiation sources, such as the radiation sources SdR1 to SdR3 are used to create both the radiating spot SR1 and the radiating spot SR2, which produces an overlap of these two radiating spots SR1 and SR2. An illustration of the placement of the −3 dB coverage areas created by a multiple-beam antenna having overlapping radiating spots is represented in FIG. 2B. Such an antenna considerably reduces the reception gaps, and can even eliminate them. However, partly because of the fact that a radiating spot is formed from a number of radiation sources that are independent of and separate from each other, at least some of which are also used for other radiating spots, this multiple-beam antenna is more complicated to control than the conventional horn antennas.

The invention seeks to overcome this problem by proposing a simpler multiple-beam antenna with overlapping radiating spots.

Its object is therefore an antenna as defined above, characterized:

in that the excitation device is designed to work simultaneously at least about a first and a second separate working frequencies, in that the excitation device includes a first and a second excitation elements, separate from and independent of each other, each designed to transmit and/or receive electromagnetic waves, the first excitation element being designed to work at the first working frequency and the second excitation element being designed to work at the second working frequency, in that the or each periodicity defect of the photonic bandgap material forms a leaky resonating cavity presenting a constant height in a direction orthogonal to said radiating outer surface, and predefined lateral dimensions parallel to said radiating outer surface, in that the first and the second working frequencies are designed to excite the same resonance mode of a leaky resonant cavity, this resonance mode being established identically regardless of the lateral dimensions of the cavity, so as to create on said outer surface respectively a first and a second radiating spots, each of these radiating spots representing the origin of a beam of electromagnetic waves radiated in transmit and/or receive mode by the antenna, in that each of the radiating spots has a geometric center, the position of which depends on the position of the excitation element producing it and the area of which is greater than that of the radiating element producing it, and in that the first and the second excitation elements are placed relative to each other such that the first and the second radiating spots are positioned on the outer surface of the photonic bandgap material alongside each other and partially overlapping.

In the multiple-beam antenna described above, each excitation element produces a single radiating spot forming the base or cross section at the origin of a beam of electromagnetic waves. Thus, from this point of view, this antenna is comparable to conventional horn antennas in which a horn produces a single radiating spot. The control of this antenna is therefore similar to that of a conventional horn antenna. Furthermore, the excitation elements are placed so as to overlap the radiating spots. This antenna therefore has the advantages of a multiple-beam antenna with overlapping radiating spots without the complexity of the control of the excitation elements having been increased compared with that of the multiple-beam horn antennas.

According to other features of a multiple-beam antenna according to the invention:

each radiating spot is roughly circular, the geometric center corresponding to a maximum transmitted and/or received power and the periphery corresponding to a maximum transmitted and/or received power equal to a fraction of the maximum transmitted and/or received power at its center, and the distance, in a plane parallel to the outer surface, separating the geometric centers of the two excitation elements, is strictly less than the radius of the radiating spot produced by the first excitation element added to the radius of the radiating spot produced by the second excitation element, the geometric center of each radiating spot is placed on the line perpendicular to said radiating outer surface and passing through the geometric center of the excitation element producing it, the first and the second excitation elements are placed inside one and the same cavity, the first and the second working frequencies are situated within the same narrow bandwidth created by this same cavity, the first and the second excitation elements are each placed inside separate resonating cavities, and the first and the second working frequencies are designed each to excite a resonance mode independent of the lateral dimensions of their respective cavities, an electromagnetic radiation reflector plane associated with the photonic bandgap material, this reflector plane being distorted so as to form said separate cavities, the or each cavity is of parallelepipedal shape, the device for focusing the electromagnetic waves comprises a reflector in half-cylinder shape, and the photonic bandgap material of the antenna has a convex surface corresponding to the half-cylinder-shaped surface of the reflector.

The invention also relates to a system for transmitting and/or receiving electromagnetic waves comprising:

a device for focusing the electromagnetic waves transmitted and/or received by the system on a focal point, and a transmitter and/or receiver of electromagnetic waves placed roughly at the focal point so as to transmit and/or receive said electromagnetic waves, characterized in that it comprises an antenna according to the invention, the outer radiating surface of which is placed roughly on the focal point so as to form said transmitter and/or receiver of electromagnetic waves.

According to other features of the system according to the invention:

the device for focusing the electromagnetic waves is a parabolic reflector, the device for focusing the electromagnetic waves is an electromagnetic lens.

The invention will be better understood on reading the description that follows, given purely by way of example, and made with reference to the drawings, in which.

Figure 1A:
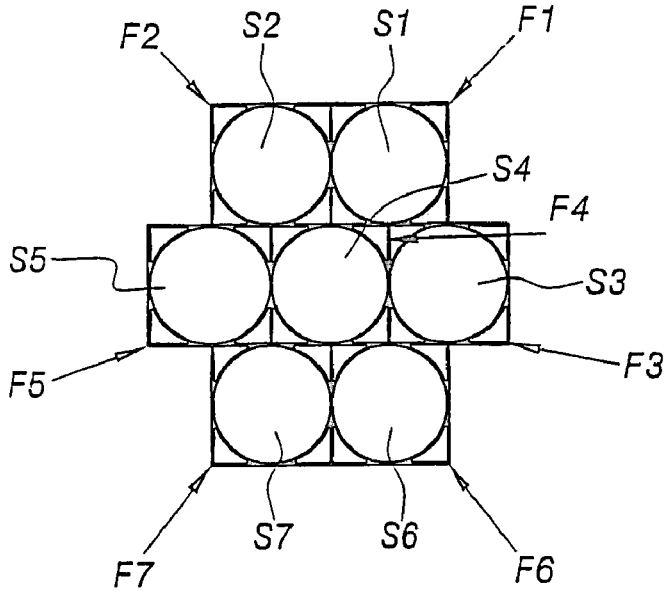
FIGS. 1A, 1B, 2A and 2B represent known multiple-beam antennas and the resulting coverage areas.
Figure 1B:
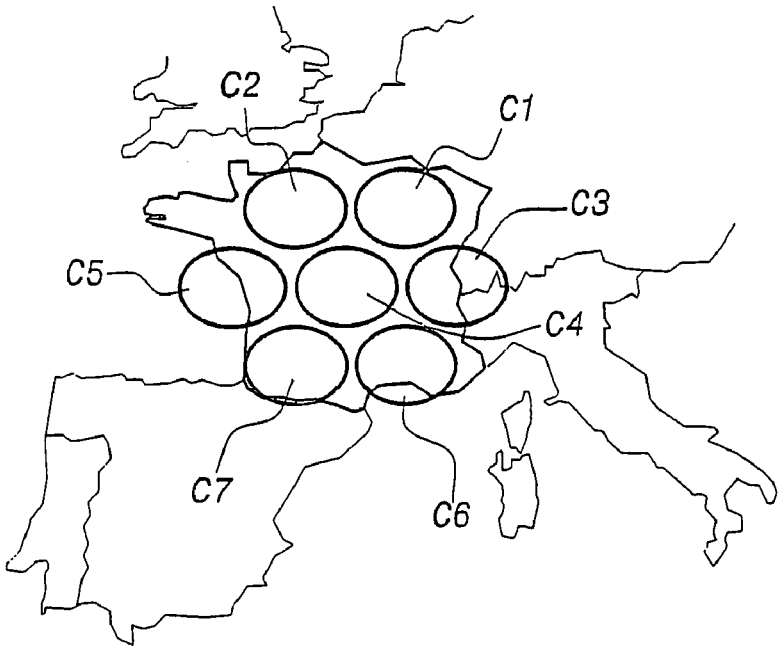
Figure 2A:
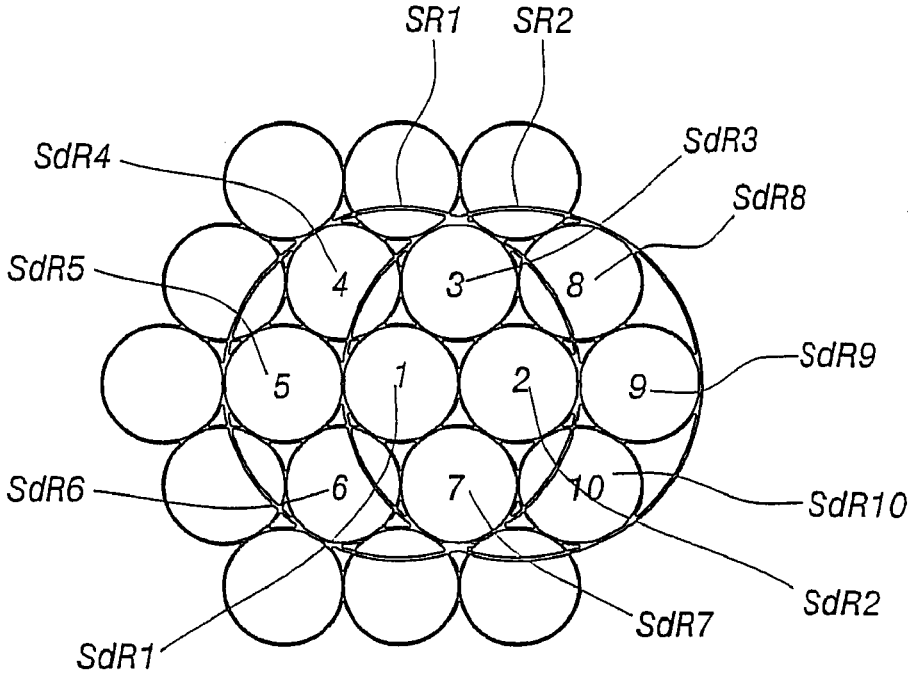
Figure 2B:
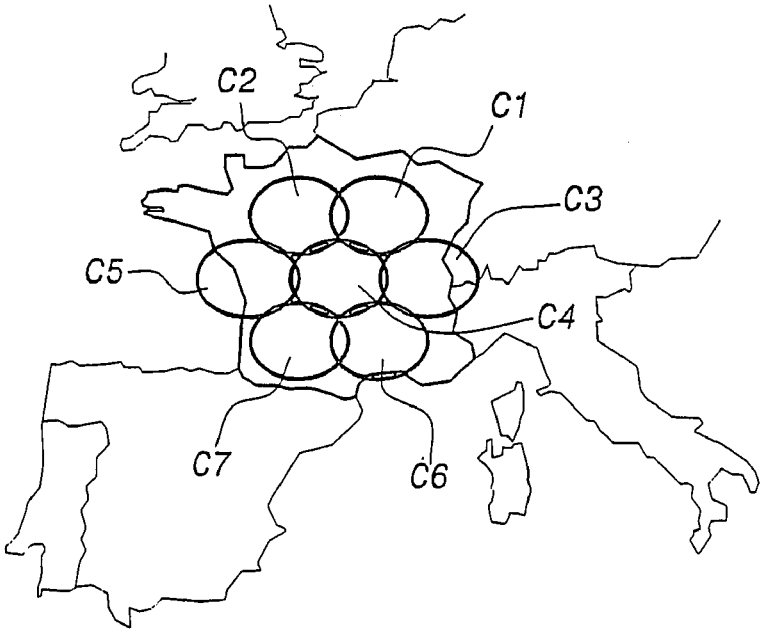
Figure 3:
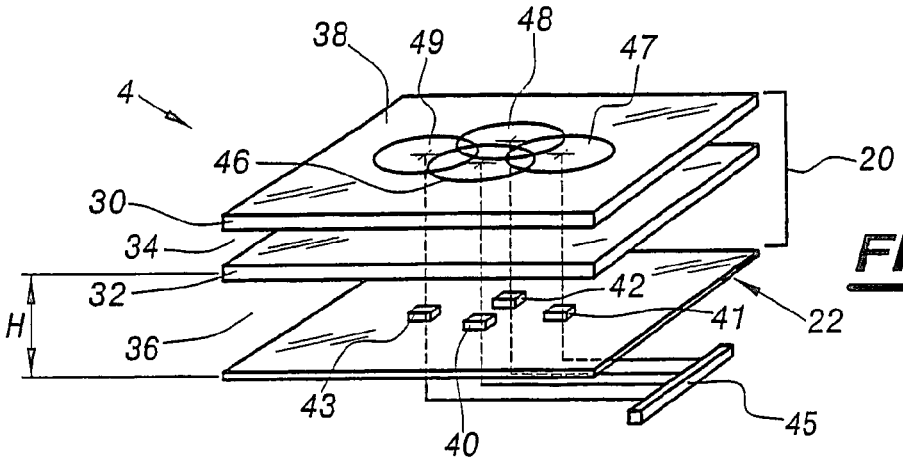
FIG. 3 is a perspective view of a multiple-beam antenna according to the invention.

FIG. 3 represents a multiple-beam antenna 4. This antenna 4 is formed of a photonic bandgap material 20 associated with a metallic plane 22 reflecting electromagnetic waves.

Photonic bandgap materials are known and the design of a photonic bandgap material such as the material 20 is, for example, described in patent application FR 99 14521. Thus, only the specific features of the antenna 4 compared to this state of the art are described here in detail.

It should be remembered that a photonic bandgap material is a material that has the property of absorbing certain frequency ranges, that is, preventing any transmission in said abovementioned frequency ranges. These frequency ranges form what is here called a bandgap.

Figure 4:
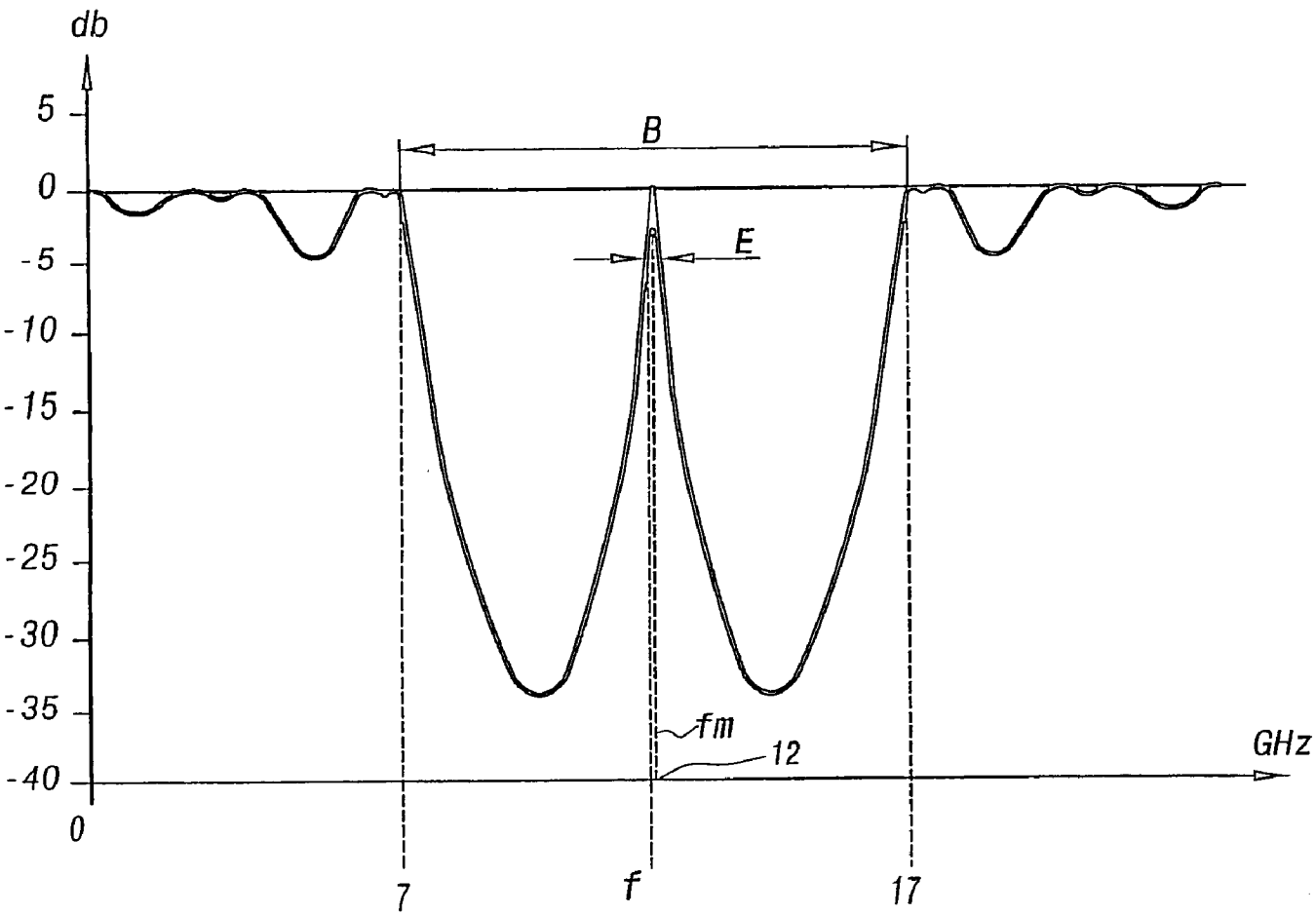
FIG. 4 is a graph representing the transmission factor of the antenna of FIG. 3.

A bandgap B of the material 20 is illustrated in FIG. 4. This FIG. 4 shows a curve representing the variations of the transmission factor expressed in decibels versus the frequency of the electromagnetic wave transmitted or received. This transmission factor is representative of the power transmitted on one side of the photonic bandgap material compared to the power received on the other side. In the case of the material 20, the bandgap B or the absorption band B extends roughly from 7 GHz to 17 GHz.

The position and the width of this bandgap B depend only on the properties and the characteristics of the photonic bandgap material.

The photonic bandgap material is normally made up of a periodic arrangement of dielectrics of variable permittivity and/or permeability. Here, the material 20 is formed from two plates 30, 32 made of a first magnetic material such as aluminum and two plates 34 and 36 made of a second magnetic material such as air. The plate 34 is sandwiched between the plates 30 and 32, while the plate 36 is sandwiched between the plate 32 and the reflecting plane 22. The plate 30 is positioned at one end of this stack of plates. It has an outer surface 38 opposite to its surface in contact with the plate 34. This surface 38 forms a radiating surface in transmit and/or receive mode.

In a known manner, the introduction of a break in this geometric and/or radiofrequency periodicity, such a break also being called a defect, can generate an absorption defect and therefore create a narrow bandwidth within the bandgap of the photonic bandgap material. The material is, in these conditions, called defective photonic bandgap material.

Here, a break in the geometric periodicity is created by choosing the height or thickness H of the plate 36 to be greater than that of the plate 34. In a known manner, and to create a narrow bandwidth E (FIG. 4) roughly in the middle of the bandwidth B, this height H is defined by the following relation:

$$H=0.5\times\lambda/\sqrt{\epsilon_r\times\mu_r}.$$

in which:

$\lambda$ is the wavelength corresponding to the median frequency $f_m$ of the bandwidth E, $\epsilon_r$ is the relative permittivity of the air, and $\mu_r$ is the relative permeability of the air.

Here, the median frequency $f_m$ is roughly equal to 1.2 GHz.

The plate 36 forms a leaky parallelepipedal resonant cavity, the height H of which is constant and the lateral dimensions of which are defined by the lateral dimensions of the photonic bandgap material 20 and of the reflector 22. These plates 30 and 32, and the reflecting plane 22, are rectangular and of identical lateral dimensions. Here, these lateral dimensions are chosen in such a way as to be several times larger than the radius R defined by the following empirical formula:

$$G_{dB} \geq 20\log\frac{\pi\Phi}{\lambda} - 2.5. \quad (1)$$

in which:

$G_{dB}$ is the gain in decibels required for the antenna, $\Phi$=2 R, $\lambda$ is the wavelength corresponding to the median frequency $f_m$.

As an example, for a gain of 20 dB, the radius R is roughly equal to 2.15 $\lambda$.

In a known manner, such a parallelepipedal resonant cavity offers a number of families of resonance frequencies. Each family of resonance frequencies is formed by a fundamental frequency and its harmonics or integer multiples of the fundamental frequency. Each resonance frequency of one and the same family excites the same resonance mode of the cavity. These resonance modes are known by the resonance mode terms $TM_0$, $TM_1$, . . . , $TM_i$, etc. These resonance modes are described in greater detail in the document by F. Cardiol, "Electromagnétisme, traité d'Electricité, d'Electronique et d'Electrotechnique", Ed. Dunod, 1987.

It should be remembered here that the resonance mode $TM_0$ is liable to be excited by a range of excitation frequencies adjacent to a fundamental frequency $f_{m0}$. Similarly, each mode $TM_i$ is liable to be excited by a range of excitation frequencies adjacent to a fundamental frequency $f_{mi}$. Each resonance mode corresponds to a radiation pattern of the particular antenna and to a radiating spot in transmit and/or receive mode formed on the outer surface 38. The radiating spot is in this case the area of the outer surface 38 containing all of the spots where the power radiated in transmit and/or receive mode is greater than or equal to half the maximum power radiated from this outer surface by the antenna 4. Each radiating spot has a geometric center corresponding to the point where the radiated power is roughly equal to the maximum radiated power.

Figure 5:
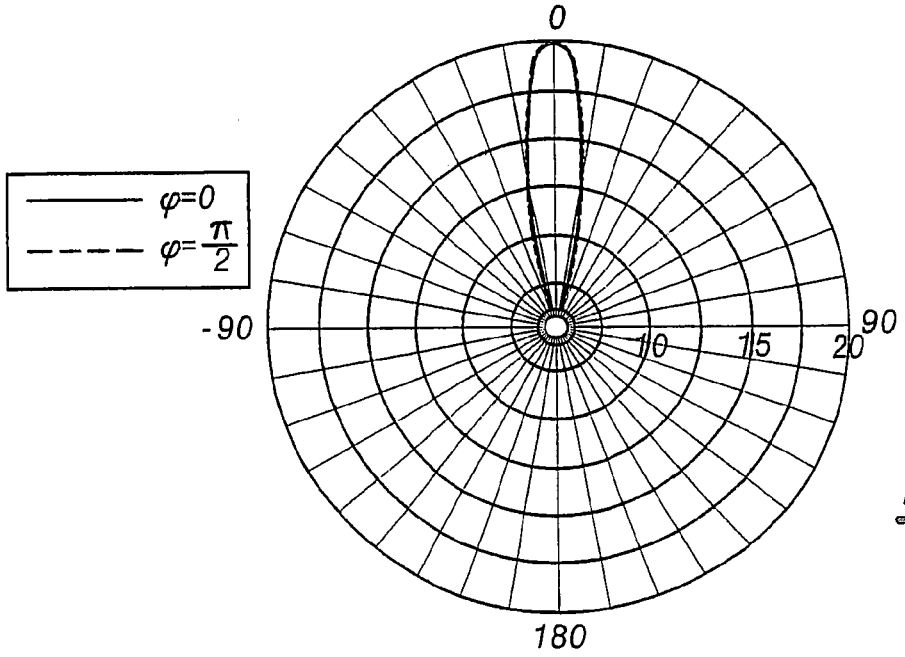
FIG. 5 is a graph representing the radiation pattern of the antenna of FIG. 3.

In the case of the resonance mode $TM_0$, this radiating spot is inscribed in a circle, the diameter $\phi$ of which is given by the formula (1). For the resonance mode $TM_0$, the radiation pattern is in this case strongly directional along a direction perpendicular to the outer surface 38 and passing through the geometric center of the radiating spot. The radiation pattern corresponding to the resonance mode $TM_0$ is illustrated in FIG. 5.

The frequencies $f_{mi}$ are placed inside the narrow bandwidth E.

Finally, four excitation elements 40 to 43 are placed alongside each other inside the cavity 36 on the reflecting plane 22. In the example described here, the geometric centers of these excitation elements are placed at the four corners of a lozenge, the dimensions of the sides of which are strictly less than 2R.

Each of these excitation elements is designed to transmit and/or receive an electromagnetic wave at a working frequency $f_{Ti}$ different from that of the other excitation elements. Here, the frequency $f_{Ti}$ of each excitation element is adjacent to $f_m$ so as to excite the resonance mode $TM_0$ of the cavity 36. These excitation elements 40 to 43 are connected to a conventional generator/receiver 45 of electrical signals to be transformed by each excitation element into an electromagnetic wave and vice versa.

These excitation elements are, for example, made of a radiating dipole, a radiating slot, a plate probe or a radiating patch. The lateral footprint of each radiating element, that is, in a plane parallel to the outer surface 38, is strictly less than the area of the radiating spot that it produces.

Figure 6:
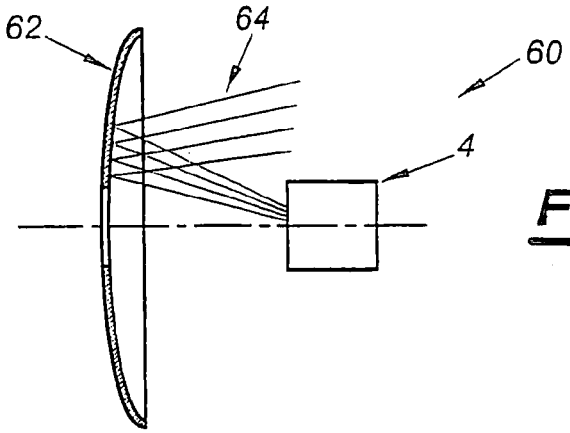
FIG. 6 is a cross-sectional diagrammatic illustration of a system for transmitting/receiving electromagnetic waves equipped with the antenna of FIG. 3.

FIG. 6 illustrates a typical application of the antenna 4. FIG. 6 represents a system 60 for transmitting and/or receiving electromagnetic waves suitable for a geostationary satellite. This system 60 includes a parabola 62 forming an electromagnetic wave beam reflector and the antenna 4 placed at the focal point of this parabola 62. The electromagnetic wave beams transmitted or received by the outer surface 38 of the antenna 4 are represented in this figure by lines 64.

The operation of the antenna of FIG. 3 will now be described in the particular case of the system of FIG. 6.

In transmit mode, the excitation element 40, activated by the generator/receiver 45, transmits an electromagnetic wave at a working frequency $f_{T0}$ and excites the resonance mode $TM_0$ of the cavity 36. The other radiating elements 41 to 43 are, for example, simultaneously activated by the generator/receiver 45 and do the same respectively at the working frequencies $f_{T1}$, $f_{T2}$ and $f_{T3}$.

It has been discovered that, for the resonance mode $TM_0$, the radiating spot and the corresponding radiation pattern are independent of the lateral dimensions of the cavity 36. In practice, the resonance mode $TM_0$ depends only on the thickness and the nature of the materials of each of the plates 30 to 36 and is established independently of the lateral dimensions of the cavity 36 when the latter are several times greater than the radius R defined previously. Thus, several resonance modes $TM_0$ can be created simultaneously alongside one another and therefore simultaneously generate several radiating spots disposed alongside one another. This is what happens when the excitation elements 40 to 43 excite, each at different points in space, the same resonance mode. Consequently, the excitation by the excitation element 40 of the resonance mode $TM_0$ is reflected in the appearance of a roughly circular radiating spot 46, the geometric center of which is situated in a line vertical to the geometric center of the element 40. Similarly, the excitation by the elements 41 to 43 of the resonance mode $TM_0$ is reflected in the appearance, in the line vertical to the geometric center of each of these elements, respectively of radiating spots 47 to 49. Since the geometric center of the element 40 is at a distance strictly less than 2R from the geometric center of the elements 41 and 43, the radiating spot 46 partly overlaps the radiating spots 47 and 49 respectively corresponding to the radiating elements 41 and 43. For the same reasons, the radiating spot 49 partly overlaps the radiating spots 46 and 48, the radiating spot 48 partly overlaps the radiating spots 49 and 47 and the radiating spot 47 partly overlaps the radiating spots 46 and 48.

Each radiating spot corresponds to the base or cross section at the origin of an electromagnetic wave beam radiated to the parabola 62 and reflected by this parabola 62 toward the Earth's surface. Thus, in a manner similar to the known multiple-beam antennas with overlapping radiating spots, the coverage areas on the Earth's surface corresponding to each of the transmitted beams are close to each other, or even overlap, so as to eliminate or reduce the reception gaps.

In receive mode, in a manner similar to what has been described in transmit mode, each radiating spot of the outer surface 38 corresponds to a coverage area on the Earth's surface. Thus, for example, if an electromagnetic wave is transmitted from the coverage area corresponding to the radiating spot 46, the latter is received in the area corresponding to the spot 46 after having been reflected by the parabola 62. If the wave received is at a frequency included in the narrowband bandwidth E, it is not absorbed by the photonic bandgap material 20 and it is received by the excitation element 40. Each electromagnetic wave received by an excitation element is transmitted in the form of an electrical signal to the generator/receiver 45.

Figure 7:
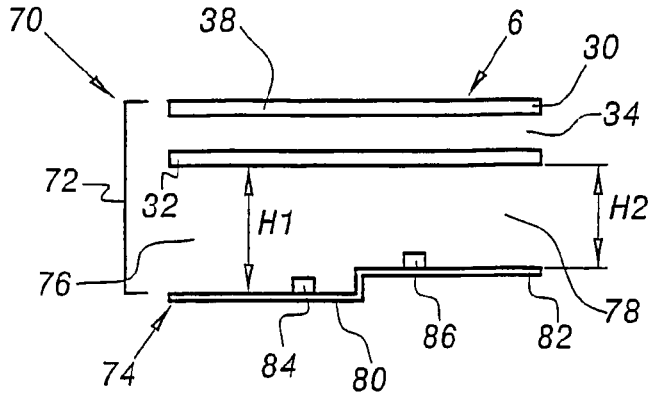
FIG. 7 represents a second embodiment of a multiple-beam antenna according to the invention.
Figure 8:
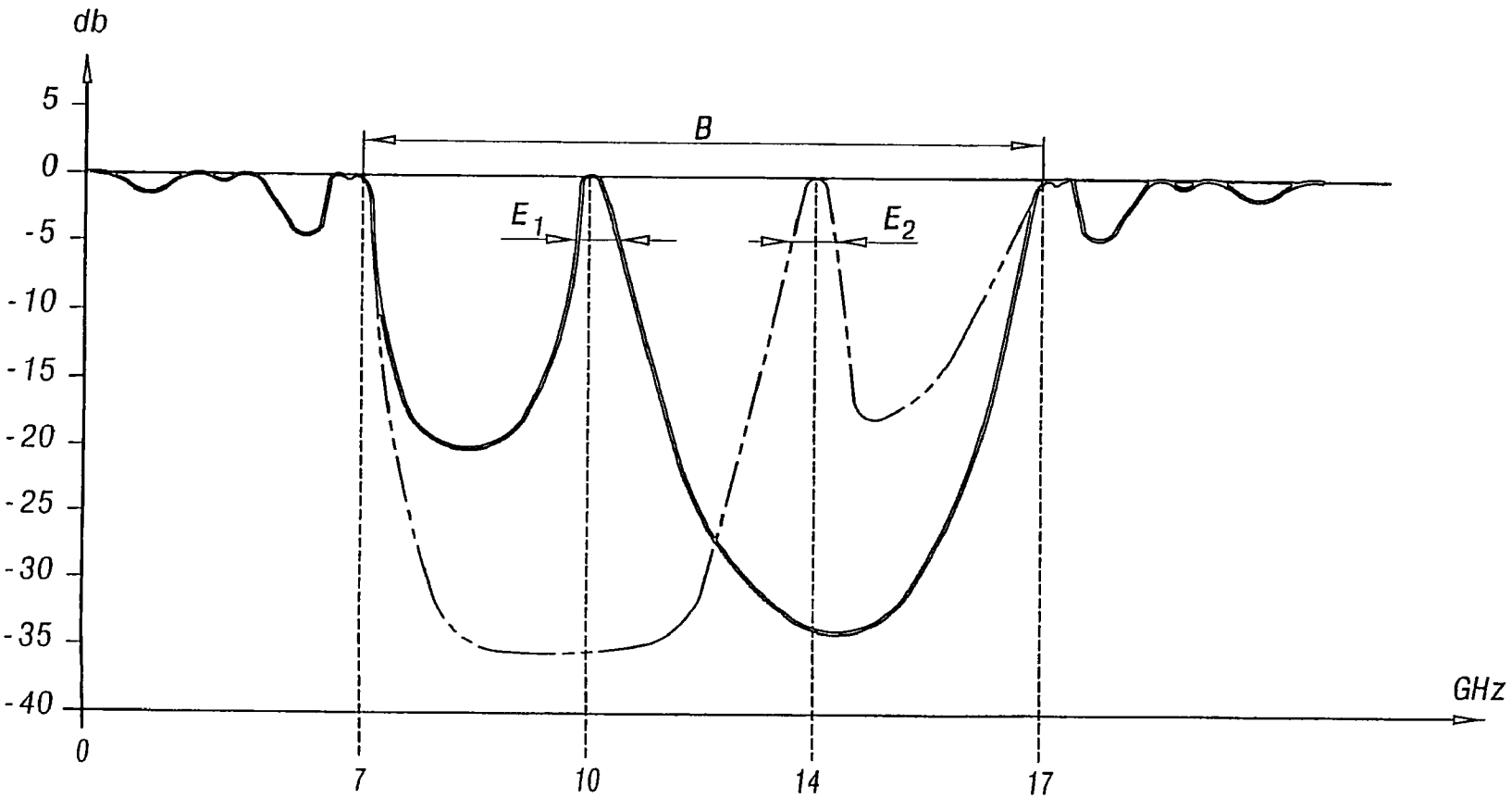
FIG. 8 represents the transmission factor of the antenna of FIG. 7.

FIG. 7 represents an antenna 70 made of a photonic bandgap material 72 and an electromagnetic wave reflector 74 and FIG. 8 shows the trend of the transmission factor of this antenna versus frequency.

The photonic bandgap material 72 is, for example, the same as the photonic bandgap material 20 and presents the same bandgap B (FIG. 8). The plates forming this photonic bandgap material already described with respect to FIG. 3 are given the same numeric references.

The reflector 74 is formed, for example, from the reflecting plane 22 distorted so as to divide the cavity 36 into two resonating cavities 76 and 78 of different heights. The constant height $H_1$ of the cavity 76 is determined in such a way as to place, within the bandgap B, a narrow bandwidth $E_1$ (FIG. 8), for example, about the 10 GHz frequency. Similarly, the height $H_2$ of the resonating cavity 78 is determined to place, within the same bandgap B, a narrow bandwidth $E_2$ (FIG. 8), for example centered about 14 GHz. The reflector 74 is in this case made up of two reflecting half-planes 80 and 82 staggered and electrically linked to each other. The reflecting half-plane 80 is parallel to the plate 32 and spaced from it by the height $H_1$. The half-plane 82 is parallel to the plate 32 and spaced from the latter by the constant height $H_2$.

Finally, an excitation element 84 is positioned in the cavity 76 and an excitation element 86 is positioned in the cavity 78. These excitation elements 84, 86 are, for example, identical to the excitation elements 40 to 43, apart from the fact that the excitation element 84 is specifically for exciting the resonance mode $TM_0$ of the cavity 76, whereas the excitation element 86 is specifically for exciting the resonance mode $TM_0$ of the cavity 78.

In this embodiment, the horizontal distance, that is, the distance parallel to the plate 32, separating the geometric center of the excitation elements 84 and 86, is strictly less than the sum of the radii of two radiating spots respectively produced by the elements 84 and 86.

The operation of this antenna 70 is identical to that of the antenna of FIG. 3. However, in this embodiment, the working frequencies of the excitation elements 84 and 86 are situated in respective narrow bandwidths $E_1$, $E_2$. Thus, unlike the antenna 4 of FIG. 3, the working frequencies of each of these excitation elements are separated from each other by a wide frequency interval, for example, in this case, 4 GHz. In this embodiment, the positions of the bandwidths $E_1$, $E_2$ are chosen so as to be able to use imposed working frequencies.

Figure 9:
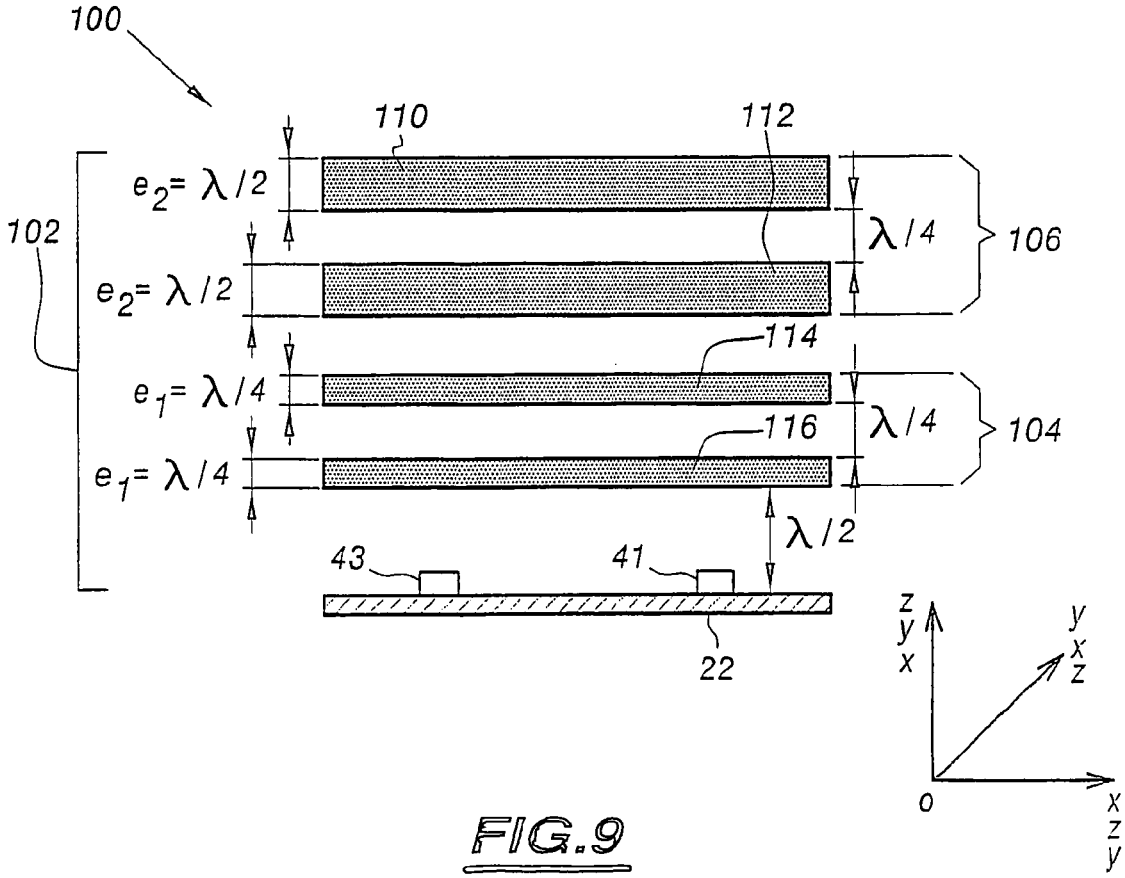
FIG. 9 represents a third embodiment of a multiple-beam antenna according to the invention.

FIG. 9 represents a multiple-beam antenna 100. This antenna 100 is similar to the antenna 4 apart from the fact that the single-defect photonic bandgap material 20 of the radiating device 4 is replaced by a photonic bandgap material 102 with several defects. In FIG. 7, the elements already described with regard to FIG. 4 are given the same numeric references.

The antenna 100 is represented in cross-section through a cutting plane perpendicular to the reflecting plane 22 and passing through the excitation elements 41 and 43.

The photonic bandgap material 102 has two successive groupings 104 and 106 of plates made of a first dielectric material. The groupings 104 and 106 are stacked in the direction perpendicular to the reflecting plane 22. Each grouping 104, 106 is formed, by way of nonlimiting example, respectively by two plates 110, 112 and 114, 116 parallel to the reflecting plane 22. Each plate of a grouping has the same thickness as the other plates of this same grouping. In the case of the grouping 106, each plate has a thickness $e_2=\lambda/2$ in which $\lambda$ denotes the wavelength of the median frequency of the narrow band created by the defects of the photonic bandgap material.

Each plate of the grouping 104 has a thickness $e_1=\lambda/4$.

The calculation of these thicknesses $e_1$ and $e_2$ follows from the teaching disclosed in French patent 99 14521 (2 801 428).

Between each plate of the defective photonic bandgap material 102 is sandwiched a plate made of a second dielectric material, such as air. The thickness of these plates separating the plates 110, 112, 114 and 116 is equal to $\lambda/4$.

The first plate 116 is positioned facing the reflecting plane 22 and separated from this plane by a plate of a second dielectric material of thickness $\lambda/2$ so as to form a leaky parallelepipedal resonating cavity. Preferably, the thickness $e_i$ of the plates of dielectric material of each consecutive group of plates of dielectric material, is in geometrical progression of ratio q in the direction of the successive groupings 104, 106.

Furthermore, in the embodiment described here, by way of nonlimiting example, the number of stacked groupings is equal to two so as not to overload the drawing, and the geometrical progression ratio is also equal to 2. These values are not limiting.

This stacking of groupings of photonic bandgap material having characteristics of different magnetic permeability, dielectric permittivity and thickness $e_i$ increases the width of the narrow bandwidth created within the same bandgap of the photonic bandgap material. Thus, the working frequencies of the radiating elements 40 to 43 are chosen to be further apart from each other than in the embodiment of FIG. 3.

The operation of this radiating device 100 derives directly from that of the antenna 4.

As a variant, the parabola 62 is replaced by an electromagnetic lens.

Figure 10:
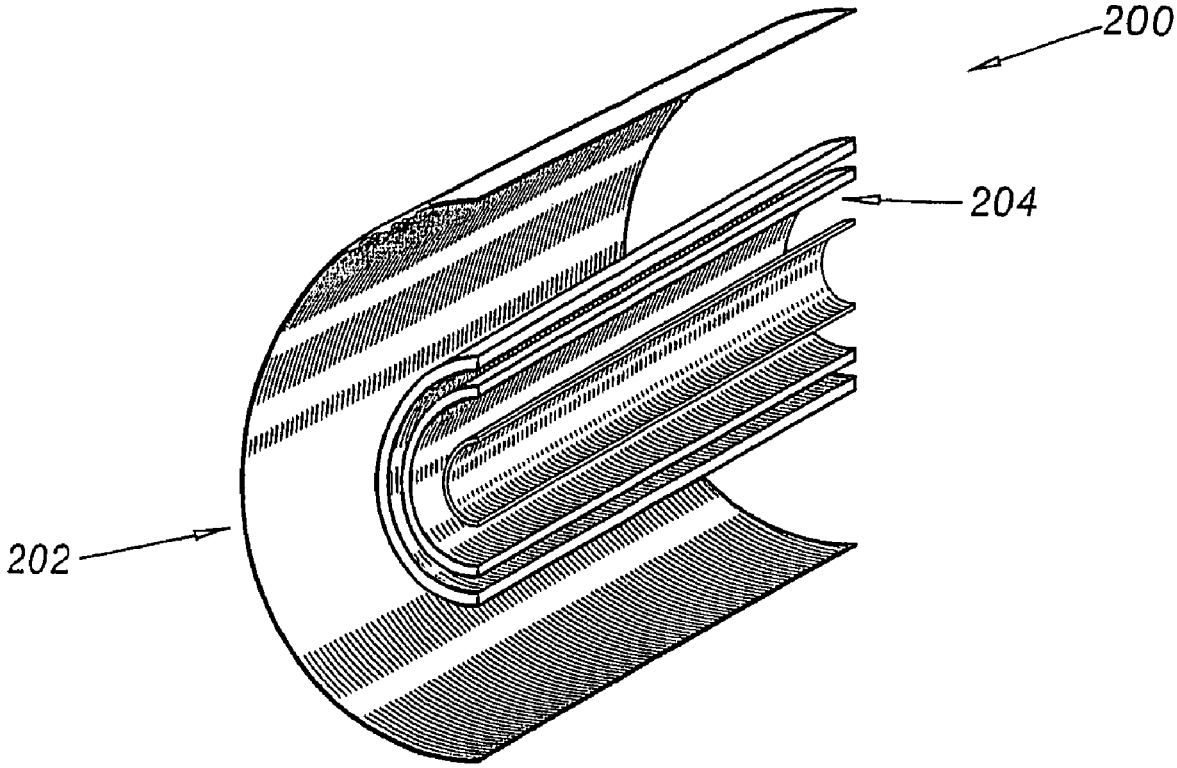
FIG. 10 is an illustration of a half-cylindrical antenna according to the invention.

The radiating devices described hitherto are made of flat structures. However, as a variant, the surface of these various elements is adapted to the shape of the parabola or of the device for focusing the electromagnetic wave beams. For example, FIG. 10 represents an antenna 200 equipped with a device 202 for focusing the electromagnetic wave beams on an antenna 204. The device 202 is, for example, a metallic reflector of half-cylindrical shape. The antenna 204 is placed at the focal point of this device 202. The antenna 204 is similar to the antenna of FIG. 3, apart from the fact that the reflecting plane, and the plates of the defective photonic bandgap material, each have a convex surface corresponding to the concave surface of the half-cylinder.

As a variant, the radiation transmitted or received by each excitation element is polarized in a direction different to that used by the adjacent excitation elements. Advantageously, the polarization of each excitation element is perpendicular to that used by the adjacent excitation elements. Thus, the interference and couplings between adjacent excitation elements are limited.

As a variant, one and the same excitation element is adapted to operate successively or simultaneously at several different working frequencies. Such an element can be used to create a coverage area in which, for example, transmission and reception take place at different wavelengths. Such an excitation element is also suitable for frequency switching.

The invention claimed is:

1. A system for transmitting and/or receiving electromagnetic waves comprising:

a device for focusing the electromagnetic waves transmitted and/or received by the system on a focal point, and a transmitter and/or receiver of electromagnetic waves placed roughly at the focal point so as to transmit and/or receive said electromagnetic waves, wherein it comprises a multiple-beam antenna, the outer radiating surface of which is placed roughly on the focal point so as to form said transmitter and/or receiver of electromagnetic waves, the antenna comprises:

a photonic bandgap material designed to filter the electromagnetic waves spacewise and frequency-wise, this photonic bandgap material having at least one bandgap and forming an outer surface radiating in transmit and/or receive mode, at least one periodicity defect of the photonic bandgap material so as to produce at least one narrow bandwidth within said at least one bandgap of this photonic bandgap material, and an excitation device for transmitting and/or receiving electromagnetic waves within said at least one narrow bandwidth produced by said at least one defect, this excitation device being designed to work simultaneously at least about a first and a second separate working frequencies, the excitation device includes a first and a second excitation elements, separate from and independent of each other, each designed to transmit and/or receive electromagnetic waves, the first excitation element being designed to work at the first working frequency and the second excitation element being designed to work at the second working frequency, the or each periodicity defect of the photonic bandgap material forms a leaky resonating cavity presenting a constant height in a direction perpendicular to said radiating outer surface, and predefined lateral dimensions parallel to said radiating outer surface, the first and the second working frequencies are designed to excite the same resonance mode of a leaky resonant cavity, this resonance mode being established identically regardless of the lateral dimensions of the cavity, so as to create on said outer surface respectively a first and a second radiating spots, each of these radiating spots representing the origin of a beam of electromagnetic waves radiated in transmit and/or receive mode by the antenna, each of the radiating spots has a geometric center, the position of which depends on the position of the excitation element producing it and the area of which is greater than that of the radiating element producing it, and the first and the second excitation elements are placed relative to each other such that the first and the second radiating spots are positioned on the outer surface of the photonic bandgap material alongside each other and partially overlap.

2. The system as claimed in claim 1, wherein the device for focusing the electromagnetic waves is a parabolic reflector.

3. The system as claimed in claim 1, wherein the device for focusing the electromagnetic waves is an electromagnetic lens.

4. The system as claimed in claim 1, wherein:

each radiating spot is roughly circular, the geometric center corresponding to a maximum transmitted and/or received power and the periphery corresponding to a maximum transmitted and/or received power equal to a fraction of the maximum transmitted and/or received power at its center, and the distance, in a plane parallel to the outer surface, separating the geometric centers of the two excitation elements is strictly less than the radius of the radiating spot produced by the first excitation element added to the radius of the radiating spot produced by the second excitation element.

5. The system as claimed in claim 1, wherein the geometric center of each radiating spot is placed on the line perpendicular to said radiating outer surface and passing through the geometric center of the excitation element producing it.

6. The system as claimed in claim 1, wherein the first and the second excitation elements are placed inside one and the same cavity.

7. The system as claimed in claim 6, wherein the first and the second working frequencies are situated within the same narrow bandwidth created by this same cavity.

8. The system as claimed in claim 1, wherein the first and the second excitation elements are each placed inside separate resonating cavities, and the first and the second working frequencies are designed each to excite a resonance mode independent of the lateral dimensions of their respective cavities.

9. An antenna as claimed in claim 8, wherein it comprises an electromagnetic radiation reflector plane associated with the photonic bandgap material, this reflector plane being distorted so as to form said separate cavities.

10. The system as claimed in claim 1, wherein the or each cavity is of parallelepipedal shape.

11. The system as claimed in claim 1, wherein the device for focusing the electromagnetic waves comprises a reflector in half-cylinder shape, and the photonic bandgap material of the antenna has a convex surface corresponding to the half-cylinder-shaped surface of the reflector.

* * * * *